US010180269B2

(12) United States Patent
Miyagi et al.

(10) Patent No.: US 10,180,269 B2
(45) Date of Patent: Jan. 15, 2019

(54) REFRIGERATION DEVICE

(71) Applicant: SANDEN HOLDINGS CORPORATION, Isesaki-shi, Gunma (JP)

(72) Inventors: Kosuke Miyagi, Isesaki (JP); Junichi Suda, Isesaki (JP); Yusuke Hiji, Isesaki (JP); Masataka Hayakawa, Isesaki (JP); Kazuhiro Omote, Isesaki (JP)

(73) Assignee: Sanden Holdings Corporation, Isesaki-shi, Gunma (JP)

( * ) Notice: Subject to any disclaimer, the term of this patent is extended or adjusted under 35 U.S.C. 154(b) by 125 days.

(21) Appl. No.: 15/126,845

(22) PCT Filed: Mar. 16, 2015

(86) PCT No.: PCT/JP2015/057718
§ 371 (c)(1),
(2) Date: Sep. 16, 2016

(87) PCT Pub. No.: WO2015/141633
PCT Pub. Date: Sep. 24, 2015

(65) Prior Publication Data

US 2017/0089614 A1 Mar. 30, 2017

(30) Foreign Application Priority Data

Mar. 19, 2014 (JP) ..... 2014-055974

(51) Int. Cl.
*F25B 7/00* (2006.01)
*F25B 5/02* (2006.01)
(Continued)

(52) U.S. Cl.
CPC ..... *F25B 7/00* (2013.01); *F25B 5/02* (2013.01); *F25B 6/00* (2013.01); *F25B 6/02* (2013.01);
(Continued)

(58) Field of Classification Search
CPC ..... F25B 5/02; F25B 6/00; F25B 6/02; F25B 7/00; F25B 9/008; F25B 40/02;
(Continued)

(56) References Cited

U.S. PATENT DOCUMENTS 8,959,951 B2 * 2/2015 Fujimoto ..... F25B 1/10 62/223
2010/0175400 A1 * 7/2010 Kasahara ..... F25B 1/10 62/225
(Continued)

FOREIGN PATENT DOCUMENTS

JP 2000-205672 A 7/2000
JP 2001-091074 A 4/2001
(Continued)

OTHER PUBLICATIONS

European Patent Office; Extended European Search Report issued in European Application No. 15 765 394.0, dated Oct. 27, 2017.
(Continued)

*Primary Examiner* — Marc Norman
(74) *Attorney, Agent, or Firm* — Baker Botts L.L.P.

(57) ABSTRACT

There is disclosed a refrigeration device in which a cooling capability and efficiency can be improved by controlling a high pressure side pressure of a low stage side refrigerant circuit into an optimum value. A refrigeration device 1 includes a high stage side refrigerant circuit 4, first and second low stage side refrigerant circuits 6A and 6B, and cascade heat exchangers 43A and 43B to evaporate a refrigerant of the high stage side refrigerant circuit 4, thereby cooling high pressure side refrigerants of the low stage side refrigerant circuits 6A and 6B, and carbon dioxide is charged as the refrigerant in each of the refrigerant circuits 4, 6A and 6B, and in the device, there are disposed pressure adjusting
(Continued)

expansion valves 31 to adjust high pressure side pressures of the low stage side refrigerant circuits 6A and 6B.

20 Claims, 6 Drawing Sheets

(51) Int. Cl.

| | |
|---|---|
| ***F25B 9/00*** | (2006.01) |
| ***F25B 40/02*** | (2006.01) |
| ***F25B 49/02*** | (2006.01) |
| ***F25B 6/00*** | (2006.01) |
| ***F25B 41/04*** | (2006.01) |
| ***F25B 6/02*** | (2006.01) |

(52) U.S. Cl.
CPC ..... *F25B 9/008* (2013.01); *F25B 40/02* (2013.01); *F25B 41/043* (2013.01); *F25B 49/02* (2013.01); *F25B 2309/061* (2013.01); *F25B 2341/0662* (2013.01); *F25B 2400/22* (2013.01); *F25B 2500/19* (2013.01); *F25B 2600/17* (2013.01); *F25B 2600/2513* (2013.01); *F25B 2700/2102* (2013.01); *F25B 2700/2103* (2013.01); *F25B 2700/2106* (2013.01); *F25B 2700/21152* (2013.01); *F25B 2700/21175* (2013.01)

(58) Field of Classification Search
CPC ..... F25B 2309/061; F25B 2600/17; F25B 2700/2106; F25B 2700/2513
USPC ..... 62/175, 222, 225
See application file for complete search history.

(56) References Cited

U.S. PATENT DOCUMENTS

| | | | | |
|---|---|---|---|---|
| 2010/0300135 | A1* | 12/2010 | Otake | F24D 17/02 62/335 |
| 2011/0154839 | A1 | 6/2011 | Mihara et al. | |
| 2013/0180278 | A1 | 7/2013 | Yamashita et al. | |
| 2013/0227979 | A1 | 9/2013 | Kasuka et al. | |

FOREIGN PATENT DOCUMENTS

| | | | |
|---|---|---|---|
| JP | 2004-279014 | A | 10/2004 |
| JP | 2011-133206 | A | 7/2011 |
| JP | 2012-112617 | A | 6/2012 |
| JP | 2012-112622 | A | 6/2012 |
| JP | 2012-193866 | A | 10/2012 |
| JP | 2013-181513 | A | 9/2013 |
| JP | 2014-016055 | A | 1/2014 |
| WO | 2012/002248 | A1 | 1/2012 |
| WO | 2012/060164 | A1 | 5/2012 |
| WO | 2013/111786 | A1 | 8/2013 |
| WO | 2014/030238 | A1 | 2/2014 |

OTHER PUBLICATIONS

Patent Office of Japan; Notification of Reasons for Refusal issued in Japanese Patent Application No. 2014-055974, dated Oct. 17, 2017.
Japan Patent Office, International Search Report issued in International Application No. PCT/JP2015/057718, dated May 26, 2015.
Japan Patent Office, Notification of Reasons for Refusal issued in Japanese Patent Application No. 2014-055974, dated May 29, 2018.

* cited by examiner

REFRIGERATION DEVICE

CROSS-REFERENCE TO RELATED APPLICATIONS

This application is a U.S. National Stage Patent Application under 37 U.S.C. § 371 of International Patent Application No. PCT/JP2015/057718, filed on Mar. 16, 2015, which claims the benefit of Japanese Patent Application No. JP 2014-055974, filed on Mar. 19, 2014, the disclosures of each of which are incorporated herein by reference in their entirety.

TECHNICAL FIELD

The present invention relates to a refrigeration device in which a high stage side refrigerant circuit and a low stage side refrigerant circuit are connected in cascade and in which carbon dioxide is charged as a refrigerant in each refrigerant circuit.

BACKGROUND ART

Heretofore, in a store such as a convenience store or a supermarket, there have been installed a plurality of showcases to display and sell articles while cooling the articles in display chambers. An evaporator to cool an interior of the display chamber is disposed in each showcase, and to this evaporator, a refrigerant is supplied from a refrigerator unit installed, for example, outside the store.

Furthermore, in recent years, carbon dioxide has been used as the refrigerant also in this type of showcase, considering from global environmental problems, but a comparatively large type of compressor is required to compress this carbon dioxide. To eliminate such a problem, there has been developed a refrigeration device in which a high stage side refrigerant circuit and a low stage side refrigerant circuit independently constituting refrigerant closed circuits, respectively, are connected in cascade, and a refrigerant of the high stage side refrigerant circuit is evaporated to subcool a high pressure side refrigerant of the low stage side refrigerant circuit, so that a required refrigerating capability can be obtained in an evaporator of the low stage side refrigerant circuit (e.g., see Patent Document 1 and Patent Document 2).

CITATION LIST

Patent Documents

Patent Document 1: Japanese Patent Application Publication No. 2001-91074

Patent Document 2: Japanese Patent Application Publication No. 2000-205672

SUMMARY OF THE INVENTION

Problems to be Solved by the Invention

Here, FIG. 6 illustrates a p-h diagram of a low stage side refrigerant circuit of a concerned refrigeration device. In the drawing, an ordinate shows a high pressure side pressure of the low stage side refrigerant circuit, L1 shows a saturated liquid line, L2 shows a saturated vapor line, L3 shows an isotherm of +40° C., and L4 shows an isotherm of +100° C. to +120° C., respectively. Furthermore, in the drawing, X1 shows a difference in specific enthalpy in cooling a refrigerant of +100° C. to +120° C. down to +40° C., when the high pressure side pressure of the low stage side refrigerant circuit is 9 MPa, and X2 shows a difference in specific enthalpy in cooling the refrigerant of +100° C. to +120° C. down to +40° C., when the high pressure side pressure of the low stage side refrigerant circuit is 7.5 MPa.

A carbon dioxide refrigerant is cooled in a supercritical state in a gas cooler, and hence a sensible heat change results. Further, as it is also clear from FIG. 6, it is seen that when the high pressure side pressure of the low stage side refrigerant circuit is higher, i.e., 9 MPa, the difference in the specific enthalpy is larger than when the high pressure side pressure is 7.5 MPa, and thus, a refrigerating capability heightens.

Furthermore, FIG. 7 shows a relation between the high pressure side pressure of the low stage side refrigerant circuit and a capability of each heat exchanger (at a high temperature of 38° C. in summer on conditions different from those of FIG. 6). Furthermore, in the drawing, a rhomboid shows a low stage side gas cooler, a quadrangle shows a high stage side gas cooler, a triangle shows a cascade heat exchanger, and a circle shows COP, respectively. As it is also clear from this drawing, it is seen that the efficiency COP improves in a region shown by X3 in the drawing, i.e., a region in which the high pressure side pressure of the low stage side refrigerant circuit is high. For example, in the case of the refrigeration device of this example, it is seen that under an environment where an outdoor air temperature is +38° C., the efficiency COP is maximized, when the high pressure side pressure of the low stage side refrigerant circuit is about 10.5 MPa.

Thus, in the case where carbon dioxide is used as the refrigerant, an optimum value (10.5 MPa at the above-mentioned outdoor air temperature of +38° C.) is present in terms of the refrigerating capability and efficiency, in the high pressure side pressure of the low stage side refrigerant circuit, and this is in a comparatively high region. However, heretofore, the high pressure side pressure of the low stage side refrigerant circuit has depended on a throttling degree of an expansion valve disposed in a showcase, and hence it has not been possible to control the high pressure side pressure of the low stage side refrigerant circuit into the optimum value.

Furthermore, in the case of carbon dioxide, a high pressure rises fast, and hence the high pressure side pressure of the low stage side refrigerant circuit is monitored so that cut error is not generated under an abnormally high pressure, and when the high pressure rises, it is necessary to lower an operation frequency of a low stage side compressor, thereby inhibiting the high pressure from abnormally rising. On the other hand, heretofore, there has been the case that there is disposed an internal heat exchanger to perform heat exchange between a high pressure side refrigerant of the low stage side refrigerant circuit and a refrigerant flowing out from a low stage side evaporator of the low stage side refrigerant circuit, for the purpose of improving the refrigerating capability. However, a temperature of the refrigerant sucked into the low stage side compressor rises, and hence the high pressure tends to be high especially in the summer in which the outdoor air temperature heightens, and control to decrease the operation frequency works, so that the pressure only increases to be about 9 MPa in FIG. 7, which also causes the problem that the high pressure side pressure does not rise to the optimum value.

The present invention has been developed to solve such conventional technical problems, and an object thereof is to provide a refrigeration device in which a cooling capability and efficiency can be improved by controlling a high pressure side pressure of a low stage side refrigerant circuit into an optimum value.

Means for Solving the Problems

To achieve the above object, according to the present invention, a refrigeration device includes a high stage side refrigerant circuit, a low stage side refrigerant circuit, and a cascade heat exchanger to evaporate a refrigerant of the high stage side refrigerant circuit, thereby cooling a high pressure side refrigerant of the low stage side refrigerant circuit, and the device in which carbon dioxide is charged as the refrigerant in each of the refrigerant circuits is characterized in that there is disposed a pressure adjusting expansion valve to adjust a high pressure side pressure of the low stage side refrigerant circuit.

The refrigeration device in the invention of claim 2 is characterized in that in the above invention, the refrigeration device includes a controller to control the pressure adjusting expansion valve, and this controller defines the optimum high pressure side pressure as a target value to control the pressure adjusting expansion valve, on the basis of the high pressure side pressure of the low stage side refrigerant circuit.

The refrigeration device in the invention of claim 3 is characterized in that in the above invention, the controller beforehand holds information indicating a relation between an outdoor air temperature and the optimum high pressure side pressure at the outdoor air temperature, and calculates the target value of the high pressure side pressure on the basis of the outdoor air temperature.

The refrigeration device in the invention of claim 4 is characterized in that in the above respective inventions, the refrigerant flowing out from a low stage side evaporator of the low stage side refrigerant circuit is sucked into a low stage side compressor of the low stage side refrigerant circuit without performing heat exchange between the refrigerant and the high pressure side refrigerant of the low stage side refrigerant circuit, and an accumulator is disposed on a suction side of this low stage side compressor.

The refrigeration device in the invention of claim 5 is characterized in that in the above respective inventions, the low stage side refrigerant circuit has a low stage side compressor and a low stage side gas cooler, and the cascade heat exchanger subcools the refrigerant flowing out from the low stage side gas cooler.

The refrigeration device in the invention of claim 6 is characterized in that in the above respective inventions, the refrigeration device includes the plurality of low stage side refrigerant circuits, and the plurality of cascade heat exchangers disposed in the respective low stage side refrigerant circuits, respectively, and the high stage side refrigerant circuit has a plurality of high stage side gas coolers connected in parallel, a plurality of high stage side expansion valves connected to outlets of the respective high stage side gas coolers, respectively, and a plurality of high stage side evaporators connected to outlets of the respective high stage side expansion valves, respectively, to constitute the respective cascade heat exchangers, respectively.

The refrigeration device in the invention of claim 7 is characterized in that in the inventions of claim 1 to claim 5, the refrigeration device includes the plurality of low stage side refrigerant circuits, and the plurality of cascade heat exchangers disposed in the respective low stage side refrigerant circuits, respectively, and the high stage side refrigerant circuit has a high stage side gas cooler, a high stage side expansion valve connected to an outlet of this high stage side gas cooler, and a plurality of high stage side evaporators connected in parallel to an outlet of this high stage side expansion valve to constitute the respective cascade heat exchangers, respectively.

The refrigeration device in the invention of claim 8 is characterized in that in the inventions of claim 1 to claim 5, the refrigeration device includes the plurality of low stage side refrigerant circuits, and the plurality of cascade heat exchangers disposed in the respective low stage side refrigerant circuits, respectively, and the high stage side refrigerant circuit has a high stage side gas cooler, a high stage side expansion valve connected to an outlet of this high stage side gas cooler, and a plurality of high stage side evaporators connected in series to an outlet of this high stage side expansion valve to constitute the respective cascade heat exchangers, respectively.

Advantageous Effect of the Invention

According to the present invention, in a refrigeration device which includes a high stage side refrigerant circuit, a low stage side refrigerant circuit, and a cascade heat exchanger to evaporate a refrigerant of the high stage side refrigerant circuit, thereby cooling a high pressure side refrigerant of the low stage side refrigerant circuit and in which carbon dioxide is charged as the refrigerant in each of the refrigerant circuits, there is disposed a pressure adjusting expansion valve to adjust a high pressure side pressure of the low stage side refrigerant circuit. Therefore, for example, as in the invention of claim 2, a controller to control the pressure adjusting expansion valve defines the optimum high pressure side pressure as a target value to control the pressure adjusting expansion valve, on the basis of the high pressure side pressure of the low stage side refrigerant circuit. Consequently, a specific enthalpy difference of the high pressure side refrigerant of the low stage side refrigerant circuit can be acquired, and advancement of a cooling capability and improvement of an efficiency can be achieved.

In this case, as in the invention of claim 3, the controller beforehand holds information indicating a relation between an outdoor air temperature and the optimum high pressure side pressure at the outdoor air temperature, and calculates the target value of the high pressure side pressure on the basis of the outdoor air temperature, so that by the pressure adjusting expansion valve, it is possible to smoothly control the high pressure side pressure of the low stage side refrigerant circuit into an optimum value.

Furthermore, as in the invention of claim 4, the refrigerant flowing out from a low stage side evaporator of the low stage side refrigerant circuit is sucked into a low stage side compressor of the low stage side refrigerant circuit without performing heat exchange between the refrigerant and the high pressure side refrigerant of the low stage side refrigerant circuit, so that especially in summer in which the outdoor air temperature heightens or the like, an abnormal rise of the high pressure side pressure of the low stage side refrigerant circuit can be prevented, and it is also possible to smoothly perform the control into the optimum high pressure side pressure. Furthermore, the refrigerant having a high density can be sucked into the low stage side compressor, and hence the efficiency also improves.

Especially in this case, an accumulator is disposed on a suction side of the low stage side compressor, and hence liquid backflow to the low stage side compressor can be prevented. Furthermore, the accumulator functions as a liquid reservoir, and hence it is also possible to charge a sufficient amount of refrigerant in the low stage side refrigerant circuit.

Furthermore, according to the invention of claim 5, in addition to the above respective inventions, the low stage side refrigerant circuit has a low stage side compressor and a low stage side gas cooler, and the cascade heat exchanger subcools the refrigerant flowing out from the low stage side gas cooler. Therefore, the refrigerant of the low stage side refrigerant circuit which is cooled in the low stage side gas cooler can further be subcooled in the cascade heat exchanger, and further improvement of the cooling capability can be achieved.

Furthermore, according to the invention of claim 6, in addition to the above respective inventions, the refrigeration device includes the plurality of low stage side refrigerant circuits, and the plurality of cascade heat exchangers disposed in the respective low stage side refrigerant circuits, respectively, and hence the high pressure side refrigerants of the plurality of low stage side refrigerant circuits can be subcooled in one high stage side refrigerant circuit. In this case, the high stage side refrigerant circuit has a plurality of high stage side gas coolers connected in parallel, a plurality of high stage side expansion valves connected to outlets of the respective high stage side gas coolers, respectively, and a plurality of high stage side evaporators connected to outlets of the respective high stage side expansion valves, respectively, to constitute the respective cascade heat exchangers, respectively, and hence also in a case where the plurality of low stage side refrigerant circuits are used, the high pressure side refrigerants of the respective low stage side refrigerant circuits can accurately be subcooled by the respective cascade heat exchangers.

Furthermore, according to the invention of claim 7, in addition to the inventions of claim 1 to claim 5, the refrigeration device includes the plurality of low stage side refrigerant circuits, and the plurality of cascade heat exchangers disposed in the respective low stage side refrigerant circuits, respectively, and hence the high pressure side refrigerants of the plurality of low stage side refrigerant circuits can similarly be subcooled in one high stage side refrigerant circuit. In this case, the high stage side refrigerant circuit has a high stage side gas cooler, a high stage side expansion valve connected to an outlet of this high stage side gas cooler, and a plurality of high stage side evaporators connected in parallel to an outlet of this high stage side expansion valve to constitute the respective cascade heat exchangers, respectively. Therefore, the refrigerant can flow from one high stage side expansion valve to the plurality of high stage side evaporators, control can be simplified, and it is also possible to achieve cost reduction.

Furthermore, according to the invention of claim 8, in addition to the inventions of claim 1 to claim 5, the refrigeration device includes the plurality of low stage side refrigerant circuits, and the plurality of cascade heat exchangers disposed in the respective low stage side refrigerant circuits, respectively, and hence the high pressure side refrigerants of the plurality of low stage side refrigerant circuits can similarly be subcooled in one high stage side refrigerant circuit. In this case, the high stage side refrigerant circuit has a high stage side gas cooler, a high stage side expansion valve connected to an outlet of this high stage side gas cooler, and a plurality of high stage side evaporators connected in series to an outlet of this high stage side expansion valve to constitute the respective cascade heat exchangers, respectively. Therefore, when an operation of one of the low stage side refrigerant circuits stops, it is possible to prevent the disadvantage that liquid backflow is generated to the high stage side compressor of the high stage side refrigerant circuit.

MODE FOR CARRYING OUT THE INVENTION

Hereinafter, embodiments of the present invention will be described in detail.

Embodiment 1

Figure 1:
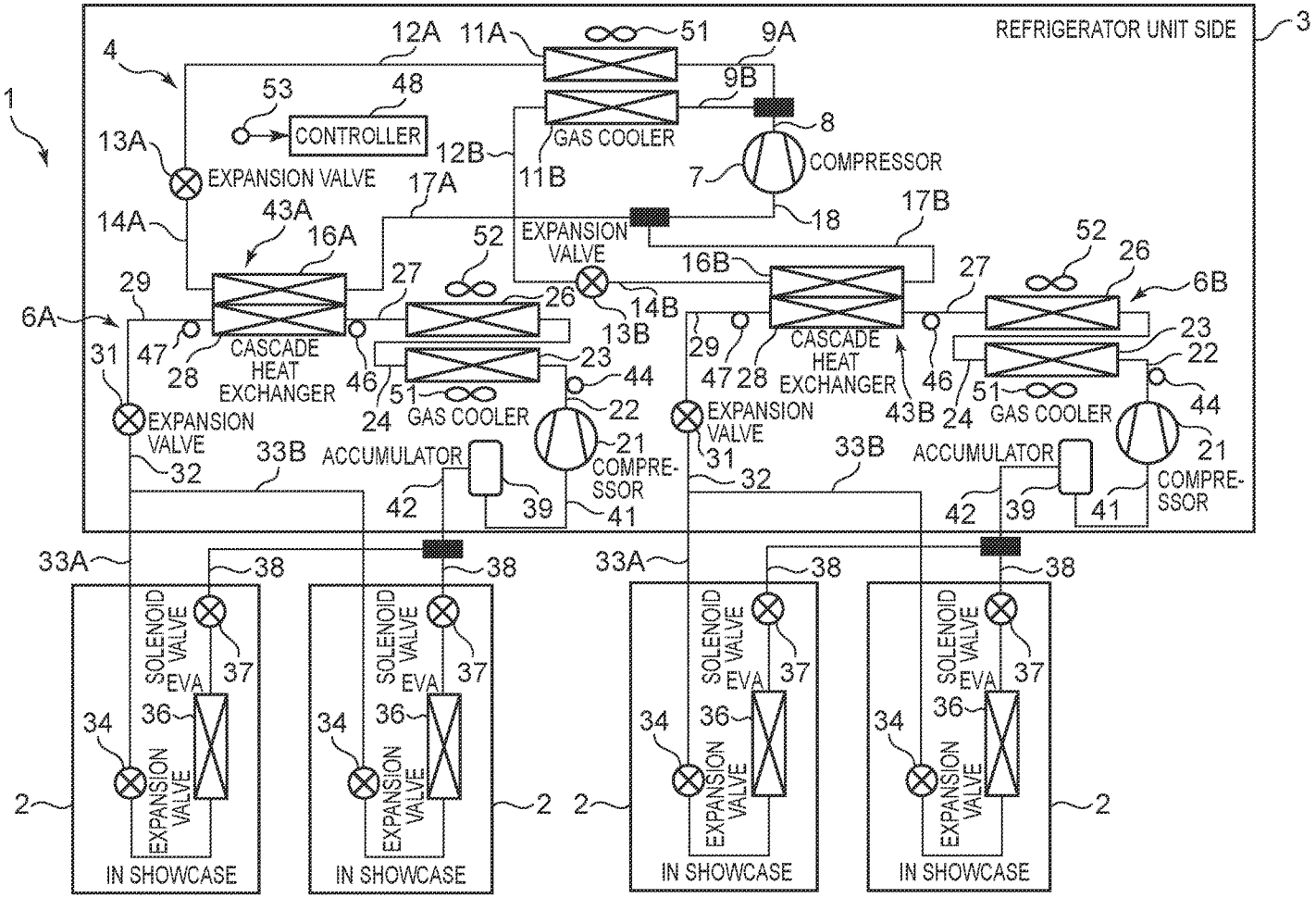
FIG. 1 is a refrigerant circuit diagram of a refrigeration device of one embodiment to which the present invention is applied (Embodiment 1)

FIG. 1 is a refrigerant circuit diagram of a refrigeration device 1 of one embodiment to which the present invention is applied. In the refrigeration device 1 of the embodiment, a refrigerant is supplied to a plurality of showcases 2 (four showcases in the embodiment) installed in a store such as a convenience store or a supermarket from a refrigerator unit 3 installed outside the store, and the refrigeration device is constituted of one high stage side refrigerant circuit 4, and a plurality (two systems in the embodiment) of low stage side refrigerant circuits 6A and 6B.

The high stage side refrigerant circuit 4 of this embodiment includes a high stage side compressor 7 constituted of a scroll compressor; first and second (a plurality of) high stage side gas coolers 11A and 11B which are connected to branch pipes 9A and 9B branched from a discharge pipe 8 of the high stage side compressor 7, respectively, and which are arranged in parallel with each other; a first high stage side expansion valve 13A connected to an outlet pipe 12A of the first high stage side gas cooler 11A; a second high stage side expansion valve 13B connected to an outlet pipe 12B of the second high stage side gas cooler 11B; a first high stage side evaporator 16A connected to an outlet pipe 14A of the first high stage side expansion valve 13A; and a second high stage side evaporator 16B connected to an outlet pipe 14B of the second high stage side expansion valve 13B, and outlet pipes 17A and 17B of the first and second high stage side evaporators 16A and 16B are joined and connected to a suction pipe 18 of the high stage side compressor 7 to constitute a refrigerating cycle. In the high stage side refrigerant circuit 4, a predetermined amount of carbon dioxide is charged as the refrigerant.

On the other hand, the low stage side refrigerant circuits 6A and 6B have the same constitution. That is, the low stage side refrigerant circuit 6A of the embodiment (or the low stage side refrigerant circuit 6B similarly) includes a low stage side compressor 21 also constituted of the scroll compressor; a first low stage side gas cooler 23 connected to a discharge pipe 22 of the low stage side compressor 21; a second low stage side gas cooler 26 connected to an outlet pipe 24 of the first low stage side gas cooler on a refrigerant downstream side of the first low stage side gas cooler 23; a subcooling heat exchanger 28 connected to an outlet pipe 27 of the second low stage side gas cooler 26; a pressure adjusting expansion valve 31 connected to an outlet pipe 29 of the subcooling heat exchanger 28; low stage side expansion valves 34 and 34 connected to branch pipes 33A and 33B branched from an outlet pipe 32 of the pressure adjusting expansion valve 31, respectively; and low stage side evaporators 36 and 36 connected to outlet sides of the respective low stage side expansion valves 34 and 34, respectively.

The low stage side expansion valve 34 and the low stage side evaporator 36 are disposed in each of two showcases 2. Further, an outlet side of the low stage side evaporator 36 in each of the showcases 2 is connected to a solenoid valve 37, outlet pipes 38 of the respective solenoid valves 37 are joined and then connected to an accumulator 39 via an inlet pipe 42, and an outlet side of the accumulator 39 is connected to a suction pipe 41 of the low stage side compressor 21 to constitute the refrigerating cycle. The accumulator 39 is a tank having a predetermined capacity. Further, in each of the low stage side refrigerant circuits 6A and 6B, a predetermined amount of carbon dioxide is charged as the refrigerant.

Further, the first high stage side evaporator 16A of the high stage side refrigerant circuit 4 and the subcooling heat exchanger 28 of the low stage side refrigerant circuit 6A are disposed in a heat exchange relation to constitute a first cascade heat exchanger 43A, and the second high stage side evaporator 16B of the high stage side refrigerant circuit 4 and the subcooling heat exchanger 28 of the low stage side refrigerant circuit 6B are disposed in a heat exchange relation to constitute a second cascade heat exchanger 43B. Further, the branch pipes 33A and 33B and the outlet pipes 38 are pipes extending from the refrigerator unit 3 to the respective showcases 2.

In the drawing, 44 denotes a pressure sensor attached to the discharge pipe 22 of the low stage side compressor 21 of each of the low stage side refrigerant circuits 6A and 6B, to detect a pressure of the high pressure side refrigerant discharged from the low stage side compressor 21. Furthermore, 46 and 47 denote temperature sensors attached to the outlet pipes 27 and 29 of each of the low stage side refrigerant circuits 6A and 6B, respectively, the temperature sensor 46 detects a temperature of the refrigerant flowing into the subcooling heat exchanger 28, and the temperature sensor 47 detects a temperature of the refrigerant flowing out from the subcooling heat exchanger 28.

In the drawing, 51 and 52 denote first and second air blowers for the gas coolers, the first air blowers 51 for the gas coolers pass air through the respective high stage side gas coolers 11A and 11B and the first low stage side gas coolers 23 to cool the air, and the second air blowers 52 for the gas coolers pass air though the second low stage side gas coolers 26 to cool the air. Furthermore, in the drawing, 53 denotes a temperature sensor which detects an outdoor air temperature. Furthermore, in the drawing, 48 denotes a controller on the side of the refrigerator unit 3, and the controller controls an operation frequency of the high stage side compressor 7 of the high stage side refrigerant circuit 4, valve positions of the respective high stage side expansion valves 13A and 13B, operation frequencies of the low stage side compressors 21 of the low stage side refrigerant circuits 6A and 6B, a valve position of the pressure adjusting expansion valve 31, and operations of the respective air blowers 51 and 52 for the gas coolers on the basis of outputs of the respective sensors 44, 46, 47, 53 and the like.

It is to be noted that the low stage side expansion valve 34 and the solenoid valve 37 on the side of the showcase 2 are controlled on the basis of a temperature in a display chamber, a temperature of cold air blown out into the display chamber, or the like, by a controller of each showcase 2, but the controller of the showcase 2 and the controller 48 of the refrigerator unit 3 are controlled in a centralized manner by an integrated control apparatus disposed in the store, and operate in cooperation with each other.

According to the above-mentioned constitution, when the controller 48 operates the high stage side compressor 7 of the high stage side refrigerant circuit 4, the low stage side compressors 21 of the low stage side refrigerant circuits 6A and 6B and the respective air blowers 51 and 52 for the gas coolers, a high-temperature high-pressure refrigerant (carbon dioxide) compressed in the high stage side compressor 7 is discharged to the discharge pipe 8, is distributed to the branch pipes 9A and 9B and then flows into the respective high stage side gas coolers 11A and 11B. The refrigerant flowing into each of the high stage side gas coolers 11A and 11B is cooled in a supercritical state by the air blower 51 for the gas cooler, and its temperature lowers.

The refrigerant cooled in the first high stage side gas cooler 11A flows into the first high stage side expansion valve 13A through the outlet pipe 12A, and is throttled in the expansion valve (pressure reduction), and then flows into the first high stage side evaporator 16A constituting the first cascade heat exchanger 43A from the outlet pipe 14A to evaporate, thereby cooling the refrigerant flowing through the subcooling heat exchanger 28 of the first low stage side refrigerant circuit 6A (subcooling). Furthermore, the refrigerant cooled in the second high stage side gas cooler 11B flows into the second high stage side expansion valve 13B through the outlet pipe 12B, is decompressed in the expansion valve, and then flows into the second high stage side evaporator 16B constituting the second cascade heat exchanger 43B from the outlet pipe 14B to evaporate, thereby cooling the refrigerant flowing through the subcooling heat exchanger 28 of the second low stage side refrigerant circuit 6B (subcooling).

Further, the refrigerants flowing out from the first and second high stage side evaporators 16A and 16B are joined through the outlet pipes 17A and 17B, and sucked from the suction pipe 18 into the high stage side compressor 7, thereby repeating this circulation.

On the other hand, the high-temperature high-pressure refrigerant (carbon dioxide) compressed in the low stage side compressor 21 of the first low stage side refrigerant circuit 6A (or similarly, the second low stage side refrigerant circuit 6B) is discharged to the discharge pipe 22, and flows into the first low stage side gas cooler 23. The refrigerant flowing into the first low stage side gas cooler 23 is cooled in the supercritical state by the air blower 51 for the gas cooler, its temperature lowers, and the refrigerant next flows into the second low stage side gas cooler 26 through the outlet pipe 24. The refrigerant flowing into the second low stage side gas cooler 26 is cooled in the supercritical state by the air blower 52 for the gas cooler, its temperature further lowers, and then the refrigerant flows into the subcooling heat exchanger 28 constituting the first cascade heat exchanger 43A (the second cascade heat exchanger 43B in the case of the second low stage side refrigerant circuit 6B) through the outlet pipe 27.

The refrigerant flowing into the subcooling heat exchanger 28 is cooled (subcooled) by the refrigerant of the high stage side refrigerant circuit 4 which evaporates in the first high stage side evaporator 16A (the second high stage side evaporator 16B in the case of the second low stage side refrigerant circuit 6B), its temperature further lowers, and then the refrigerant reaches the pressure adjusting expansion valve 31 through the outlet pipe 29.

In the pressure adjusting expansion valve 31, the high pressure side refrigerant of the low stage side refrigerant circuit 6A (6B) is throttled, is distributed to the branch pipes 33A and 33B through the outlet pipe 32, and flows out from the refrigerator unit 3 to enter into each showcase 2. The refrigerant flowing through the branch pipes 33A and 33B reaches the low stage side expansion valve 34 of each showcase 2, and is throttled in the expansion valve, and then flows into the low stage side evaporator 36 to evaporate. Due to a heat absorbing operation at this time, an interior of the display chamber of each showcase 2 is cooled at a predetermined temperature.

Further, the refrigerants flowing out from the low stage side evaporators 36 of the showcases 2 are joined through the solenoid valves 37 (it is defined that the solenoid valves 37 are opened in a case where the showcases 2 are cooled) and the outlet pipes 38, and flow into the accumulators 39 from the inlet pipes 42. The refrigerant flowing into each accumulator 39 is separated into a gas and a liquid in the accumulator, and the gas refrigerant is sucked into the low stage side compressor 21 through the suction pipe 41, thereby repeating this circulation.

The controller 48 controls the valve positions of the respective high stage side expansion valves 13A and 13B independently of each other so that the high pressure side refrigerants of the low stage side refrigerant circuits 6A and 6B are appropriately subcooled in the respective subcooling heat exchangers 28, on the basis of the temperatures of the refrigerants flowing into the subcooling heat exchangers 28 which are detected by the temperature sensors 46 disposed in the respective low stage side refrigerant circuits 6A and 6B and the temperatures of the refrigerants flowing out from the subcooling heat exchangers 28 which are detected by the temperature sensors 47 (e.g., on the basis of each difference between the temperatures). Consequently, the high pressure side refrigerants of the respective low stage side refrigerant circuits 6A and 6B are accurately subcooled by the respective cascade heat exchangers 43A and 43B.

In this way, also in a case where the refrigerant of the high stage side refrigerant circuit 4 is evaporated in the high stage side evaporators 16A and 16B of the respective cascade heat exchangers 43A and 43B and the high pressure side refrigerants of the respective low stage side refrigerant circuits 6A and 6B which flow through the subcooling heat exchangers 28 are subcooled, thereby using carbon dioxide as the refrigerants, it is possible to obtain a required cooling capability in the low stage side evaporator 36 of each showcase 2 without using comparatively large (large capacity) compressors as the compressors 7 and 21 of the respective refrigerant circuits 4, 6A and 6B.

Furthermore, the refrigerant flowing out from the low stage side evaporator 36 of each of the low stage side refrigerant circuits 6A and 6B is sucked into the low stage side compressor 21 of each of the low stage side refrigerant circuits 6A and 6B without performing the heat exchange between the refrigerant and the high pressure side refrigerant of each of the low stage side refrigerant circuits 6A and 6B. Therefore, especially in summer in which the outdoor air temperature heightens, or the like, abnormal rises of the high pressure side pressures of the low stage side refrigerant circuits 6A and 6B can be prevented, the refrigerant having a high density can be sucked into each low stage side compressor 21, and hence efficiency also improves.

In this case, the accumulator 39 is disposed on a suction side of each low stage side compressor 21, and hence liquid backflow to the low stage side compressor 21 can be prevented. Furthermore, the accumulator 39 functions as a liquid reservoir, and hence it is possible to charge a sufficient amount of carbon dioxide refrigerant in each of the low stage side refrigerant circuits 6A and 6B.

Furthermore, in the cascade heat exchangers 43A and 43B, the refrigerants flowing out from the low stage side gas coolers 26 are subcooled, and hence the carbon dioxide refrigerants of the low stage side refrigerant circuits 6A and 6B which are cooled in the low stage side gas coolers 26 and 26 are further subcooled in the cascade heat exchangers 43A and 43B, so that further improvement of the cooling capability can be achieved.

Furthermore, this embodiment includes two systems of the low stage side refrigerant circuits 6A and 6B and two cascade heat exchangers 43A and 43B which are disposed in the respective low stage side refrigerant circuits 6A and 6B, respectively, and hence the high pressure side refrigerants of the two systems (the plurality) of the low stage side refrigerant circuits 6A and 6B can be subcooled in one high stage side refrigerant circuit 4.

In this case, the high stage side refrigerant circuit 4 has two (the plurality of) high stage side gas coolers 11A and 11B connected in parallel, two (the plurality of) high stage side expansion valves 13A and 13B which are connected to outlets of the respective high stage side gas coolers 11A and 11B, respectively, and two (the plurality of) high stage side evaporators 16A and 16B which are connected to outlets of the respective high stage side expansion valves 13A and 13B, respectively, to constitute the respective cascade heat exchangers 43A and 43B, respectively. Therefore, also in a case where the two systems of the low stage side refrigerant circuits 6A and 6B are used as in the embodiment, the high pressure side refrigerants of the respective low stage side refrigerant circuits 6A and 6B can accurately be subcooled independently of each other, by the respective cascade heat exchangers 43A and 43B.

Furthermore, each of the refrigerants flowing out from the respective high stage side evaporators 16A and 16B of the high stage side refrigerant circuit 4 is sucked into the high stage side compressor 7 of the high stage side refrigerant circuit 4 without performing the heat exchange between the refrigerant and the high pressure side refrigerant of the high stage side refrigerant circuit 4, and hence especially in the summer in which the outdoor air temperature heightens or the like, the abnormal rise of the high pressure side pressure of the high stage side refrigerant circuit 4 can be prevented. Furthermore, the refrigerant having the high density can be sucked into the high stage side compressor 7, and hence the efficiency also improves.

Figure 2:
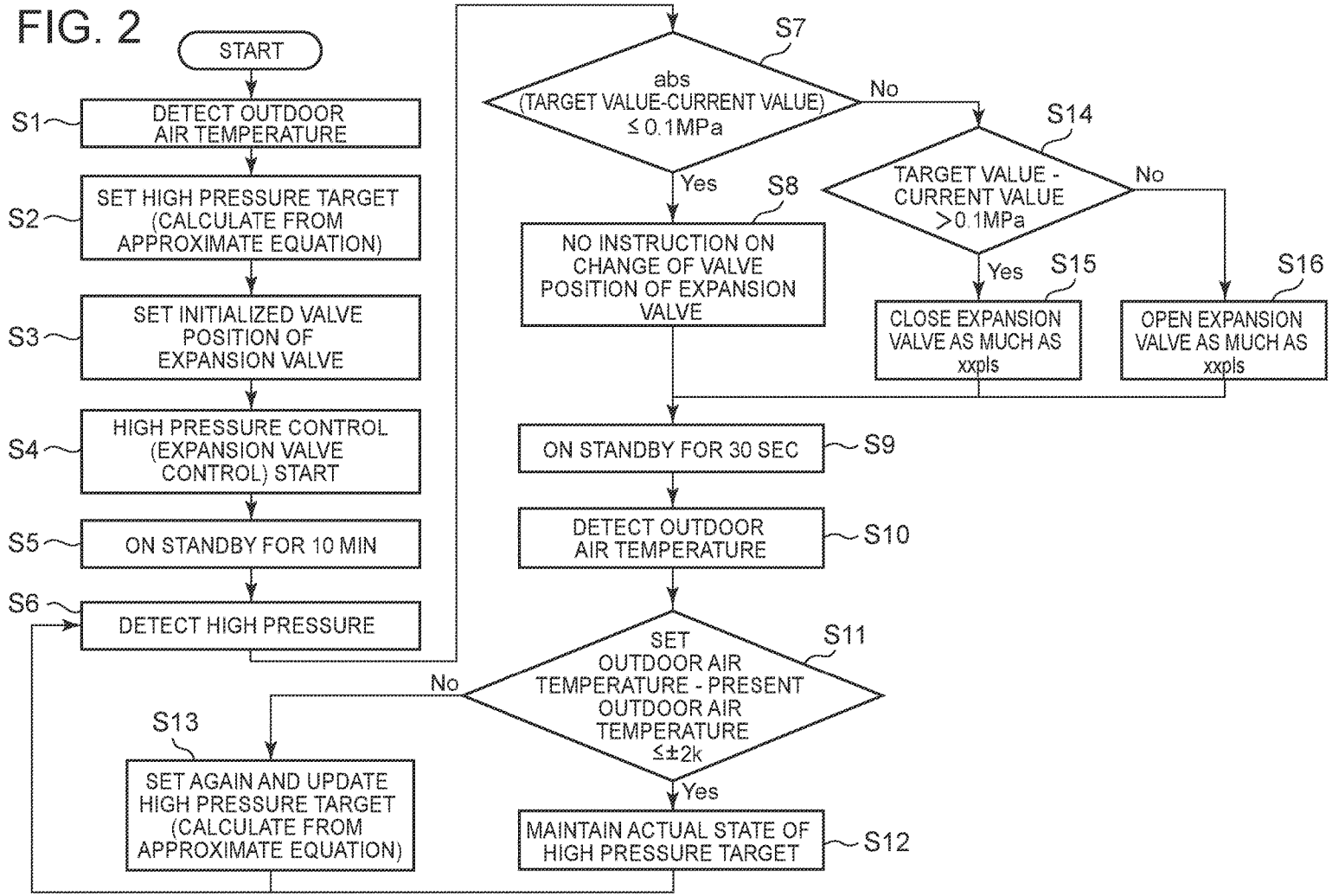
FIG. 2 is a control flowchart of a pressure adjusting expansion valve by a controller of the refrigeration device of FIG. 1.

Next, valve position control of the pressure adjusting expansion valves 31 of the respective low stage side refrigerant circuits 6A and 6B by the controller 48 will be described with reference to FIG. 2 and FIG. 3. In the embodiment, the controller 48 calculates the optimum high pressure side pressure of the low stage side refrigerant circuits 6A and 6B on the basis of the outdoor air temperature, and defines the pressure as a target value to control the valve positions of the respective pressure adjusting expansion valves 31. That is, in step S1 of a flowchart of FIG. 2, the controller 48 detects the outdoor air temperature detected by the temperature sensor 53. Next, in step S2, the controller sets the target value of the high pressure side pressure of the low stage side refrigerant circuit 6A (6B) on the basis of this outdoor air temperature.

Figure 7:
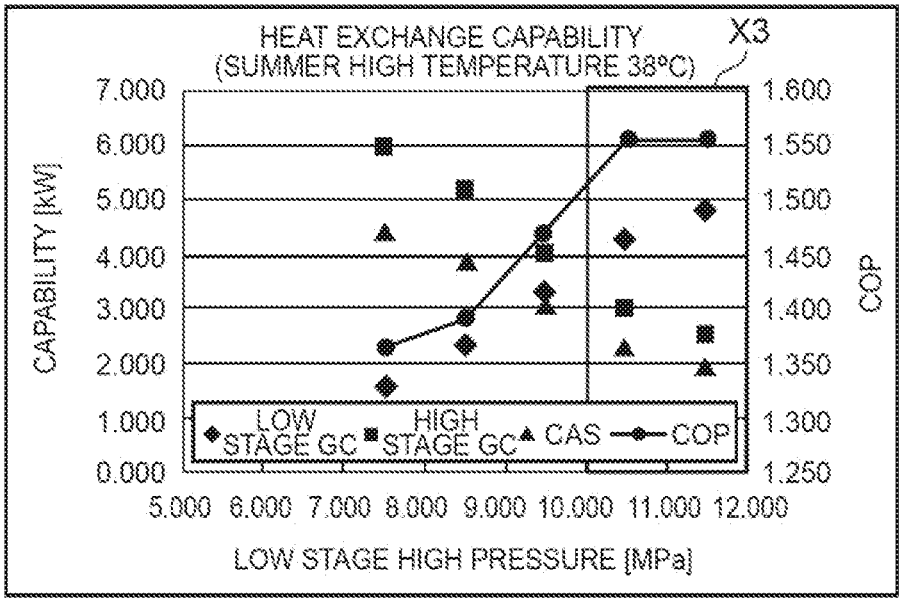
FIG. 7 is a diagram showing a relation between a high pressure side pressure of the low stage side refrigerant circuit of this type of refrigeration device and a capability of each heat exchanger.

In this case, the controller 48 beforehand holds information indicating a relation between the outdoor air temperature and the optimum high pressure side pressure of the low stage side refrigerant circuit 6A (6B) at the outdoor air temperature. Here, in the present invention, the optimum value of the high pressure side pressure means the high pressure side pressure of the low stage side refrigerant circuit 6A (6B) at which an efficiency COP becomes a maximum value or a value close to the maximum value in FIG. 7 mentioned above. An approximate equation ($y=0.1347x+5.4132$) in FIG. 3 is the information indicating the relation between the optimum high pressure side pressure of the low stage side refrigerant circuit 6A (6B) and the outdoor air temperature. In FIG. 3, an abscissa (x) shows the outdoor air temperature, an ordinate (y) indicates the optimum value of the high pressure side pressure of the low stage side refrigerant circuit 6A (6B) of the refrigeration device 1 (the pressure of the high pressure side refrigerant discharged from the low stage side compressor 21), and this approximate equation is beforehand obtained by experiments. For example, when FIG. 7 mentioned above shows an example of the refrigeration device 1, it is seen that the optimum value (y) of the high pressure side pressure=10.5 MPa in an environment where the outdoor air temperature (x)=+38° C.

In the step S2, the controller 48 calculates the optimum high pressure side pressure at this time (the optimum value of the high pressure side pressure) from the outdoor air temperature by use of this approximate equation, and sets the calculated high pressure side pressure as the target value. For example, the target value at the outdoor air temperature of +20° C. (the optimum high pressure side pressure) is about 8.1 MPa, and the target value at +30° C. is about 9.5 MPa. Next, in step S3, the controller 48 sets an initialized valve position of the pressure adjusting expansion valve 31 to initialize the valve position. Further, in step S4, the controller starts control of the high pressure side pressure of the low stage side refrigerant circuit 6A (6B) by the pressure adjusting expansion valve 31.

The controller 48 is first on standby for a predetermined time (e.g., 10 minutes) in step S5, and then detects a current high pressure side pressure detected by the pressure sensor 44 in step S6. Next, in step S7, the controller judges whether or not an absolute value (abs) of a difference (the target value−a current value) between the above target value (the optimum high pressure side pressure) and the current high pressure side pressure (the current value) is a predetermined value (e.g., 0.1 MPa) or less, and in a case where the difference is the predetermined value or less (the difference is not present or is small), the controller advances to step S8 in which the controller does not give instructions to change the valve position of the pressure adjusting expansion valve 31 (the valve position of the pressure adjusting expansion valve 31 is maintained).

Next, the controller is on standby for a predetermined time (e.g., 30 seconds) in step S9, and then detects the outdoor air temperature detected by the temperature sensor 53 again in step S10. Further, in step S11, the controller judges whether or not a difference (the set outdoor air temperature−a present outdoor air temperature) between the outdoor air temperature when the above target value is set (the outdoor air temperature in the step S1, i.e., the set outdoor air temperature) and a current outdoor air temperature (the present outdoor air temperature) is in a range of the predetermined value (e.g., ±2K). Further, in a case where the difference is in the range of the predetermined value (±2K), the controller maintains the target value of the high pressure side pressure in step S12, and returns to the step S6.

Figure 3:
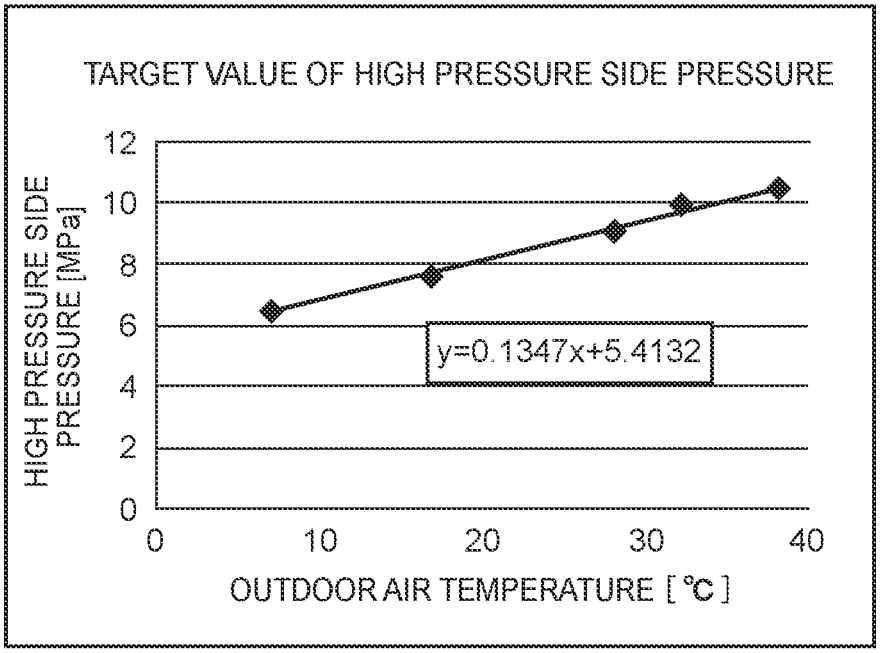
FIG. 3 is a diagram to explain a calculating operation of a target value of a high pressure side pressure of a low stage side refrigerant circuit by the controller of the refrigeration device of FIG. 1.

In a case where the difference (the set outdoor air temperature−the present outdoor air temperature) is not in the range of the predetermined value in the step S11, the controller 48 advances to step S13 to calculate the optimum high pressure side pressure at the outdoor air temperature of this time (the present outdoor air temperature) again by use of the approximate equation of FIG. 3, and sets (updates) the calculated high pressure side pressure as the target value. Further, the controller returns to the step S6. In this way, the controller 48 follows the change of the outdoor air temperature to update the target value of the high pressure side pressure of the low stage side refrigerant circuit 6A (6B).

On the other hand, in the step S7, in a case where the absolute value of the difference (the target value−the current value) between the above target value and the current high pressure side pressure (the current value) is not the predetermined value (0.1 MPa) or less (the difference is large), the controller 48 advances to step S14 to judge whether or not the difference (the target value−the current value) is larger than the predetermined value (e.g., 0.1 MPa).

Further, in a case where the current high pressure side pressure (the current value) is low and the difference (the target value−the current value) is larger than the predetermined value (0.1 MPa), the controller 48 advances to step S15 to close the valve position of the pressure adjusting expansion valve 31 as much as predetermined pulses (xx-pls). Consequently, the high pressure side refrigerant of the low stage side refrigerant circuit 6A (6B) is further dammed, when the refrigerant just flows out from the subcooling heat exchanger 28 of the cascade heat exchanger 43A (43B), and hence the high pressure side pressure of the low stage side refrigerant circuit 6A (6B) increases.

On the other hand, in a case where the current high pressure side pressure (the current value) of the low stage side refrigerant circuit 6A (6B) is high and the difference (the target value−the current value) is the predetermined value (0.1 MPa) or less, the controller 48 advances to step S16 to open the valve position of the pressure adjusting expansion valve 31 as much as predetermined pulses (xx-pls). Consequently, the high pressure side refrigerant of the low stage side refrigerant circuit 6A (6B) which flows out from the subcooling heat exchanger 28 of the cascade heat exchanger 43A (43B) flows more easily, and hence the high pressure side pressure of the low stage side refrigerant circuit 6A (6B) decreases.

The controller 48 repeats the above steps to control the high pressure side pressure of the low stage side refrigerant circuit 6A (6B) into the optimum value by the pressure adjusting expansion valve 31. That is, there are disposed the pressure adjusting expansion valves 31 to adjust the high pressure side pressures of the low stage side refrigerant circuits 6A and 6B, and the controller 48 defines the optimum high pressure side pressure as the target value to control the pressure adjusting expansion valves 31, on the basis of the high pressure side pressures of the low stage side refrigerant circuits 6A and 6B, so that a specific enthalpy difference of the high pressure side refrigerants of the low stage side refrigerant circuits 6A and 6B can be acquired and advancement of the cooling capability and the improvement of the efficiency can be achieved.

In particular, the controller 48 beforehand holds the information (the approximate equation) indicating the relation between the outdoor air temperature and the optimum high pressure side pressure at the outdoor air temperature, and calculates the target value of the high pressure side pressure on the basis of the outdoor air temperature, so that it is possible to smoothly control the high pressure side pressure of each of the low stage side refrigerant circuits 6A and 6B into the optimum value by the pressure adjusting expansion valve 31.

Embodiment 2

Figure 4:
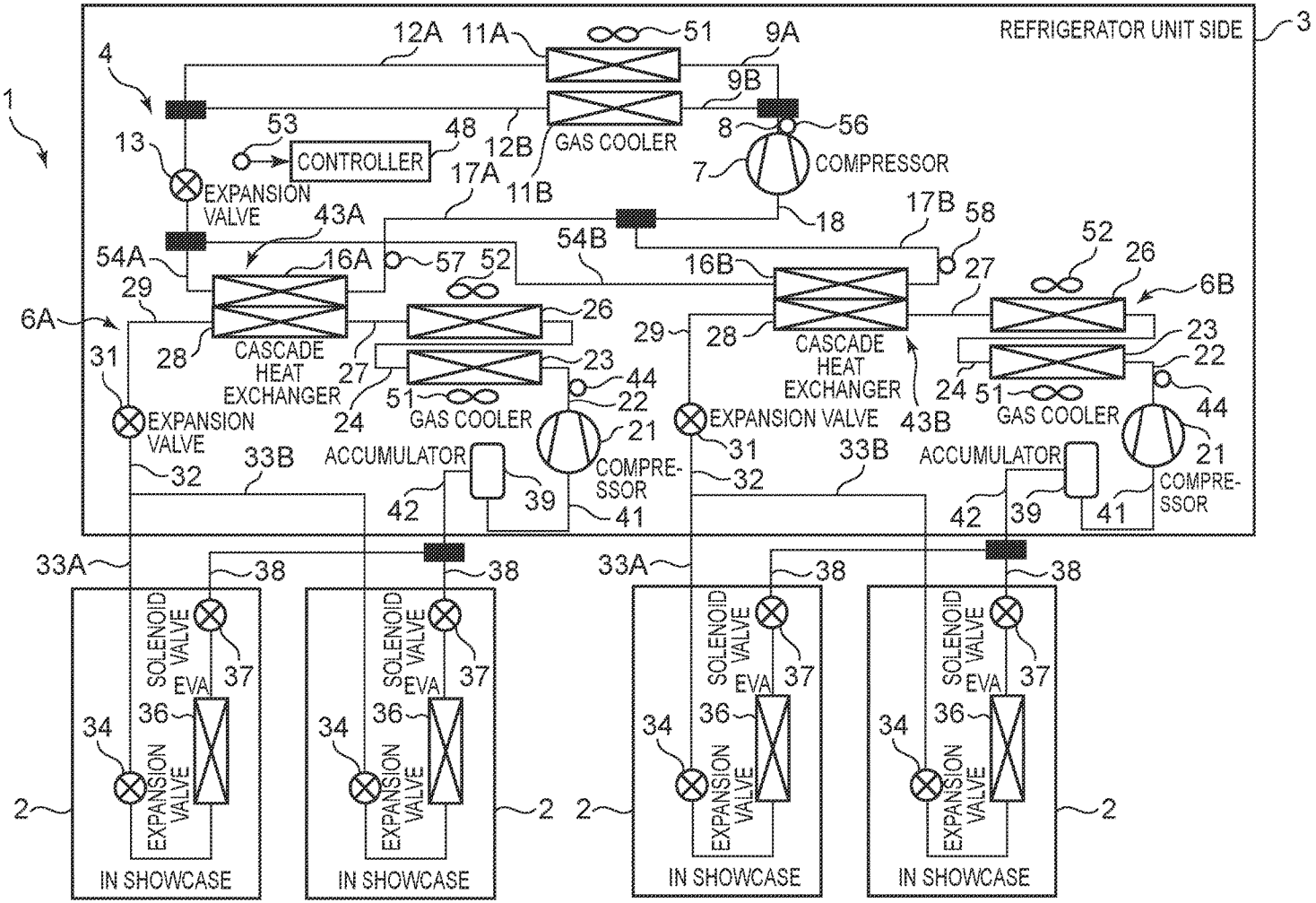
FIG. 4 is a refrigerant circuit diagram of a refrigeration device of another embodiment to which the present invention is applied (Embodiment 2)

Next, another embodiment of the refrigeration device 1 of the present invention will be described with reference to FIG. 4. It is to be noted that in this drawing, components denoted with the same reference numerals as in FIG. 1 perform the same or similar functions. Also in this embodiment, circuit constitutions of low stage side refrigerant circuits 6A and 6B are similar to those of Embodiment 1. In this case, an outlet pipe 12A of a first high stage side gas cooler 11A of a high stage side refrigerant circuit 4 and an outlet pipe 12B of a second high stage side gas cooler 11B are joined and connected to an inlet of one high stage side expansion valve 13. That is, the respective high stage side gas coolers 11A and 11B are connected in parallel between a high stage side compressor 7 and the high stage side expansion valve 13.

Furthermore, an outlet of the high stage side expansion valve 13 is branched into branch pipes 54A and 54B, one branch pipe 54A is connected to an inlet of a first high stage side evaporator 16A, and the other branch pipe 54B is connected to an inlet of a second high stage side evaporator 16B. That is, the respective high stage side evaporators 16A and 16B are connected in parallel to the outlet of the high stage side expansion valve 13.

In the drawing, 56 denotes a pressure sensor attached to a discharge pipe 8 of the high stage side compressor 7 to detect a high pressure side pressure of the high stage side refrigerant circuit 4, and in the drawing, 57 denotes a temperature sensor attached to an outlet pipe 17A to detect a temperature of a refrigerant flowing out from the first high stage side evaporator 16A, and 58 denotes a temperature sensor attached to an outlet pipe 17B to detect a temperature of a refrigerant flowing out from the second high stage side evaporator 16B. Furthermore, the temperature sensors 46 and 47 of Embodiment 1 are not disposed. The other constitution is similar to that of Embodiment 1.

In the refrigeration device 1 of this case, when a controller 48 operates the high stage side compressor 7 of the high stage side refrigerant circuit 4, low stage side compressors 21 of the low stage side refrigerant circuits 6A and 6B and respective air blowers 51 and 52 for the gas coolers, a high-temperature high-pressure refrigerant (carbon dioxide) compressed in the high stage side compressor 7 is discharged to the discharge pipe 8, is distributed to branch pipes 9A and 9B, and then flows into the respective high stage side gas coolers 11A and 11B. The refrigerants flowing into the respective high stage side gas coolers 11A and 11B are cooled in a supercritical state by the air blower 51 for the gas cooler, and temperatures lower.

Further, the refrigerants cooled in the respective high stage side gas coolers 11A and 11B are joined through the outlet pipes 12A and 12B, flow into the high stage side expansion valve 13, are throttled in the valve (pressure reduction), and are distributed to the branch pipes 54A and 54B. The refrigerant flowing into the branch pipe 54A flows into the first high stage side evaporator 16A constituting a first cascade heat exchanger 43A to evaporate, and cools the refrigerant flowing through a subcooling heat exchanger 28 of the first low stage side refrigerant circuit 6A (subcooling). Furthermore, the refrigerant flowing into the branch pipe 54B flows into the second high stage side evaporator 16B constituting a second cascade heat exchanger 43B to evaporate, and cools the refrigerant flowing through a subcooling heat exchanger 28 of the second low stage side refrigerant circuit 6B (subcooling).

Further, the refrigerants flowing out from the first and second high stage side evaporators 16A and 16B are joined through the outlet pipes 17A and 17B, and are sucked from a suction pipe 18 into the high stage side compressor 7, thereby repeating this circulation.

Furthermore, the controller 48 in this case controls an operation frequency of the high stage side compressor 7 on the basis of, for example, an average value of the temperatures of the refrigerants flowing out from the respective high stage side evaporators 16A and 16B which are detected by the temperature sensors 57 and 58. At this time, the controller 48 controls the operation frequency of the high stage side compressor 7 to perform required subcooling of the high pressure side refrigerants of the low stage side refrigerant circuits 6A and 6B in the respective cascade heat exchangers 43A and 43B.

Furthermore, the controller 48 controls the valve position of the expansion valve 13 on the basis of the high pressure side pressure of the high stage side refrigerant circuit 4 which is detected by the pressure sensor 56 in the same manner as in pressure adjusting expansion valves 31 of the low stage side refrigerant circuits 6A and 6B mentioned above, thereby controlling the high pressure side pressure of the high stage side refrigerant circuit 4 into an adequate value similar to the above-mentioned value (a target value of the high pressure side pressure of the high stage side refrigerant circuit 4). It is to be noted that operations of the low stage side refrigerant circuits 6A and 6B and control of the controller 48 concerning the operations are similar to those of Embodiment 1.

This embodiment also includes two systems (a plurality) of low stage side refrigerant circuits 6A and 6B and two (a plurality of) cascade heat exchangers 43A and 43B disposed in the respective low stage side refrigerant circuits 6A and 6B, respectively, and hence the high pressure side refrigerants of the two system (the plurality) of the low stage side refrigerant circuits 6A and 6B can similarly be subcooled in one high stage side refrigerant circuit 4. Especially, in the case of this embodiment, the high stage side refrigerant circuit 4 has the first and second high stage side gas coolers 11A and 11B, the single high stage side expansion valve 13 connected to outlets of the high stage side gas coolers 11A and 11B and two (a plurality of) high stage side evaporators 16A and 16B connected in parallel to the outlet of the high stage side expansion valve 13 to constitute the respective cascade heat exchangers 43A and 43B, respectively, and hence the refrigerant can flow from the one high stage side expansion valve 13 to the two (the plurality of) high stage side evaporators 16A and 16B, which produces the effects that the control can be simplified and that cost reduction can be achieved.

Embodiment 3

Figure 5:
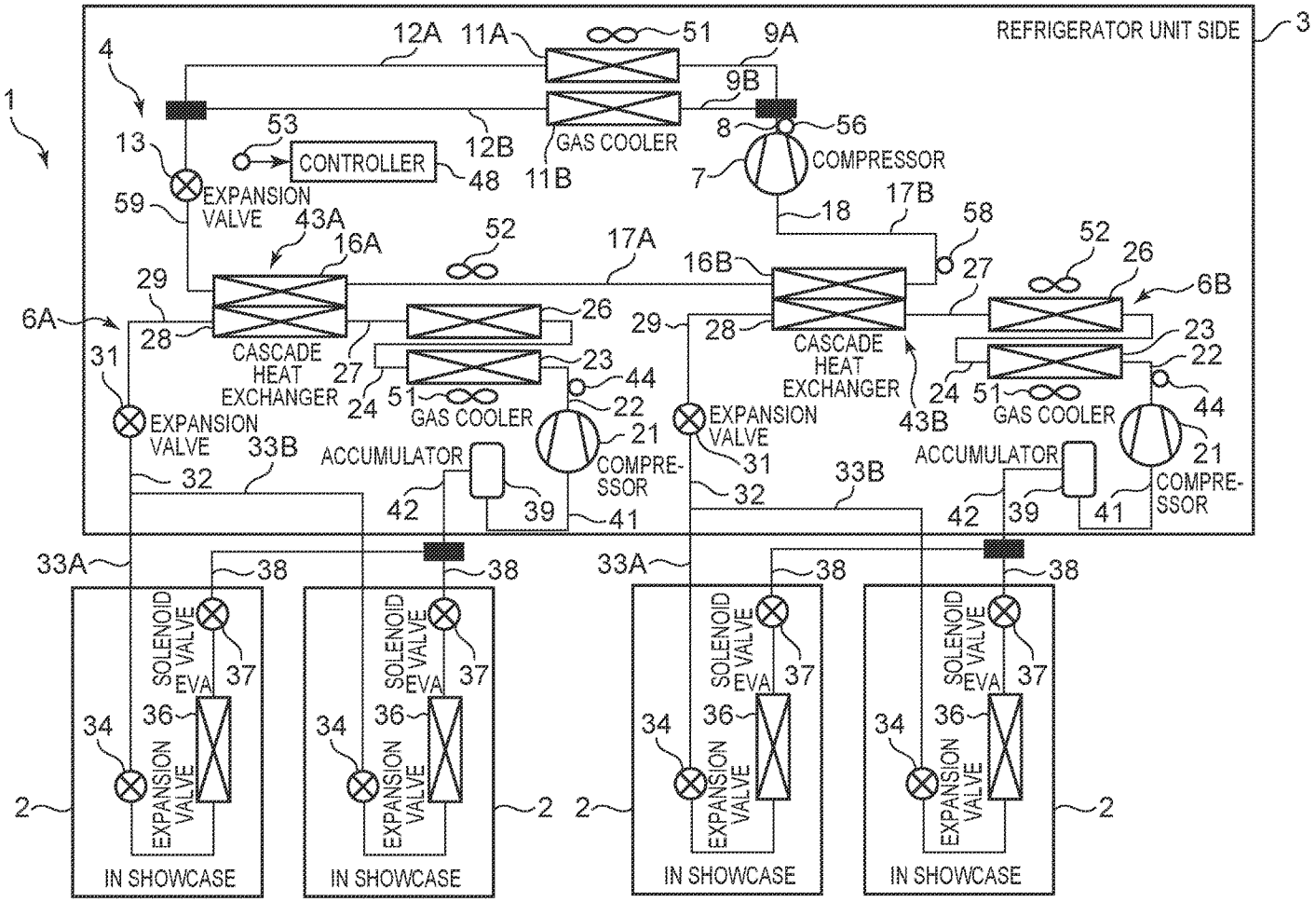
FIG. 5 is a refrigerant circuit diagram of a refrigeration device of still another embodiment to which the present invention is applied (Embodiment 3)
Figure 6:
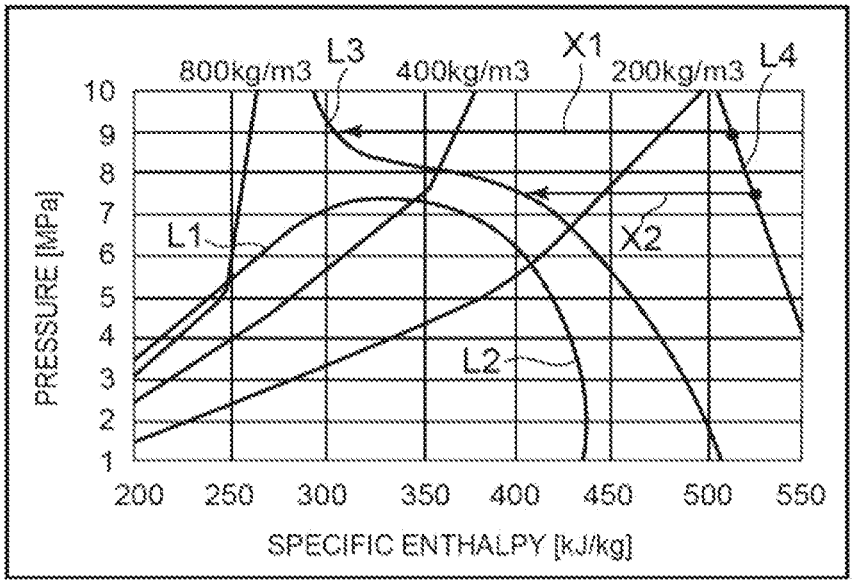
FIG. 6 is a p-h diagram of a low stage side refrigerant circuit of this type of refrigeration device.

Next, still another embodiment of the refrigeration device 1 of the present invention will be described with reference to FIG. 5. It is to be noted that in this drawing, components denoted with the same reference numerals as in FIG. 1 and FIG. 4 perform the same or similar functions. Also in this embodiment, circuit constitutions of low stage side refrigerant circuits 6A and 6B are similar to those of Embodiment 1. Also in this case, an outlet pipe 12A of a first high stage side gas cooler 11A of a high stage side refrigerant circuit 4 and an outlet pipe 12B of a second high stage side gas cooler 11B are joined and connected to an inlet of one high stage side expansion valve 13. That is, the respective high stage side gas coolers 11A and 11B are connected in parallel between a high stage side compressor 7 and the high stage side expansion valve 13.

Additionally, an outlet of the high stage side expansion valve 13 is connected to an inlet of a first high stage side evaporator 16A through an outlet pipe 59. Further, an outlet pipe 17A of the first high stage side evaporator 16A is connected to an inlet of a second high stage side evaporator 16B, and an outlet pipe 17B of the high stage side evaporator 16B is connected to a suction pipe 18 of the high stage side compressor 7. That is, the respective high stage side evaporators 16A and 16B are connected in series to an outlet of the high stage side expansion valve 13.

Furthermore, the temperature sensor 57 of Embodiment 2 mentioned above is not disposed, but a temperature sensor 58 is attached to the outlet pipe 17B to detect a temperature of a refrigerant flowing out from the second high stage side evaporator 16B. Furthermore, also in this case, the temperature sensors 46 and 47 of Embodiment 1 are not disposed. The other constitution is similar to that of Embodiment 1 or Embodiment 2.

In the refrigeration device 1 of this case, when a controller 48 operates the high stage side compressor 7 of the high stage side refrigerant circuit 4, low stage side compressors 21 of the low stage side refrigerant circuits 6A and 6B and respective air blowers 51 and 52 for the gas coolers, a high-temperature high-pressure refrigerant (carbon dioxide) compressed in the high stage side compressor 7 is discharged to a discharge pipe 8, is distributed to branch pipes 9A and 9B, and then flows into the respective high stage side gas coolers 11A and 11B. The refrigerants flowing into the respective high stage side gas coolers 11A and 11B are cooled in a supercritical state by the air blower 51 for the gas cooler, and temperatures lower.

Further, the refrigerants cooled in the respective high stage side gas coolers 11A and 11B are joined through the outlet pipes 12A and 12B, flow into the high stage side expansion valve 13, and are throttled in the valve (pressure reduction), and the refrigerant first flows into the first high stage side evaporator 16A constituting a first cascade heat exchanger 43A through the outlet pipe 59 to evaporate, and cools the refrigerant flowing through a subcooling heat exchanger 28 of the first low stage side refrigerant circuit 6A (subcooling). This refrigerant flowing out from the first high stage side evaporator 16A next flows into the second high stage side evaporator 16B constituting a second cascade heat exchanger 43B through an outlet pipe 17A to evaporate, and cools the refrigerant flowing through a subcooling heat exchanger 28 of the second low stage side refrigerant circuit 6B (subcooling).

Further, the refrigerant flowing out from the second high stage side evaporator 16B is sucked from the suction pipe 18 into the high stage side compressor 7 through the outlet pipe 17B, thereby repeating this circulation.

Furthermore, the controller 48 in this case controls an operation frequency of the high stage side compressor 7 on the basis of the temperature of the refrigerant flowing out from the second high stage side evaporator 16B which is detected by the temperature sensor 58. At this time, the controller 48 controls the operation frequency of the high stage side compressor 7 to perform required subcooling of the high pressure side refrigerants of the low stage side refrigerant circuits 6A and 6B in the respective cascade heat exchangers 43A and 43B.

Furthermore, the controller 48 controls a valve position of the expansion valve 13 on the basis of a high pressure side pressure of the high stage side refrigerant circuit 4 which is detected by a pressure sensor 56 in the same manner as in Embodiment 2, in the same manner as in pressure adjusting expansion valves 31 of the low stage side refrigerant circuits 6A and 6B mentioned above, thereby controlling the high pressure side pressure of the high stage side refrigerant circuit 4 into an adequate value similar to the above-mentioned value (a target value of the high pressure side pressure of the high stage side refrigerant circuit 4). It is to be noted that operations of the low stage side refrigerant circuits 6A and 6B and control of the controller 48 concerning the operations are similar to those of Embodiment 1.

This embodiment also includes two systems (a plurality) of low stage side refrigerant circuits 6A and 6B and two (a plurality of) cascade heat exchangers 43A and 43B disposed in the respective low stage side refrigerant circuits 6A and 6B, respectively, and hence the high pressure side refrigerants of the two system (the plurality) of the low stage side refrigerant circuits 6A and 6B can similarly be subcooled in one high stage side refrigerant circuit 4.

Here, in the case of Embodiment 2, when the operation of one of the low stage side refrigerant circuits 6A and 6B stops, there is the danger that liquid backflow is generated to the high stage side compressor 7 of the high stage side refrigerant circuit 4, but according to this embodiment, in the high stage side refrigerant circuit 4, two (a plurality of) high stage side evaporators 16A and 16B constituting the respective cascade heat exchangers, respectively, are connected in series to the outlet of the high stage side expansion valve 13 which is connected to outlets of the high stage side gas coolers 11A and 11B, the operation frequency of the high stage side compressor 7 is controlled at the temperature of the refrigerant flowing out from the second high stage side evaporator 16B on a downstream side, and hence such a disadvantage can be eliminated.

Additionally, in the case of this embodiment, based on a relation between the first high stage side evaporator 16A on an upstream side and the second high stage side evaporator 16B on the downstream side, the subcooling of the refrigerant of the low stage side refrigerant circuit 6A which is cooled in the first cascade heat exchanger 43A has priority over that of the refrigerant of the low stage side refrigerant circuit 6B during pull-down at any cost. Therefore, the low stage side refrigerant circuit 6A may be constituted to share the cooling of the showcases 2 in which loads further increase.

It is to be noted that in the embodiments, the present invention has been described in the refrigeration device in which the single high stage side refrigerant circuit and two systems of low stage side refrigerant circuits are connected in cascade, but the present invention is not limited to the embodiments, and in the refrigeration device, a single low stage side refrigerant circuit and the high stage side refrigerant circuit may be connected in cascade, or three systems or more of low stage side refrigerant circuits may be connected to the high stage side refrigerant circuit in cascade. Furthermore, in the embodiments, the present invention is applied to the refrigeration device which cools the showcases, but the present invention is not limited to the embodiments, and the present invention is also effective for a refrigeration device which cools an automatic vending machine or the like.

DESCRIPTION OF REFERENCE NUMERALS

1 refrigeration device
2 showcase
3 refrigerator unit
4 high stage side refrigerant circuit
6A and 6B low stage side refrigerant circuit
7 high stage side compressor
11A and 11B high stage side gas cooler
13A, 13B and 13 high stage side expansion valve
16A and 16B high stage side evaporator
21 low stage side compressor
23 and 26 low stage side gas cooler
28 subcooling heat exchanger
31 pressure adjusting expansion valve
34 low stage side expansion valve
36 low stage side evaporator
39 accumulator
48 controller
51 and 52 air blower for the gas cooler

The invention claimed is:

1. A refrigeration device which comprises a high stage side refrigerant circuit, a low stage side refrigerant circuit, and a cascade heat exchanger to evaporate a refrigerant of the high stage side refrigerant circuit, thereby cooling a high pressure side refrigerant of the low stage side refrigerant circuit and in which carbon dioxide is charged as the refrigerant in each of the refrigerant circuits, wherein the low stage side refrigerant circuit has a low stage side compressor, a low stage side expansion valve and a low stage side evaporator, wherein there is disposed a pressure adjusting expansion valve coupled to an outlet pipe of the cascade heat exchanger and configured to adjust a high pressure side pressure of the low stage side refrigerant circuit.

2. The refrigeration device according to claim 1, which comprises a controller to control the pressure adjusting expansion valve, wherein the controller defines an optimum high pressure side pressure as a target value to control the pressure adjusting expansion valve, on the basis of the high pressure side pressure of the low stage side refrigerant circuit.

3. The refrigeration device according to claim 2, wherein the controller stores information indicating a relation between an outdoor air temperature and the optimum high pressure side pressure at the outdoor air temperature, and calculates the target value of the high pressure side pressure on the basis of the outdoor air temperature.

4. The refrigeration device according to claim 3, wherein the refrigerant flowing out from a low stage side evaporator of the low stage side refrigerant circuit is sucked into a low stage side compressor of the low stage side refrigerant circuit without performing heat exchange between the refrigerant and the high pressure side refrigerant of the low stage side refrigerant circuit, and an accumulator is disposed on a suction side of the low stage side compressor.

5. The refrigeration device according to claim 3, wherein the low stage side refrigerant circuit has a low stage side compressor and a low stage side gas cooler, and the cascade heat exchanger subcools the refrigerant flowing out from the low stage side gas cooler.

6. The refrigeration device according to claim 3, which comprises a plurality of low stage side refrigerant circuits, and a plurality of cascade heat exchangers disposed in the respective low stage side refrigerant circuits, respectively, wherein the high stage side refrigerant circuit has a plurality of high stage side gas coolers connected in parallel, a plurality of high stage side expansion valves connected to outlets of the respective high stage side gas coolers, respectively, and a plurality of high stage side evaporators connected to outlets of the respective high stage side expansion valves, respectively, to constitute the respective cascade heat exchangers, respectively.

7. The refrigeration device according to claim 2, wherein the optimum high pressure side pressure is a high pressure side pressure of the low stage side refrigerant circuit at which an efficiency COP becomes a maximum value or a value close to the maximum value.

8. The refrigeration device according to claim 2, wherein the refrigerant flowing out from a low stage side evaporator of the low stage side refrigerant circuit is sucked into a low stage side compressor of the low stage side refrigerant circuit without performing heat exchange between the refrigerant and the high pressure side refrigerant of the low stage side refrigerant circuit, and an accumulator is disposed on a suction side of the low stage side compressor.

9. The refrigeration device according to claim 2, wherein the low stage side refrigerant circuit has a low stage side compressor and a low stage side gas cooler, and the cascade heat exchanger subcools the refrigerant flowing out from the low stage side gas cooler.

10. The refrigeration device according to claim 2, which comprises a plurality of low stage side refrigerant circuits, and a plurality of cascade heat exchangers disposed in the respective low stage side refrigerant circuits, respectively, wherein the high stage side refrigerant circuit has a plurality of high stage side gas coolers connected in parallel, a plurality of high stage side expansion valves connected to outlets of the respective high stage side gas coolers, respectively, and a plurality of high stage side evaporators connected to outlets of the respective high stage side expansion valves, respectively, to constitute the respective cascade heat exchangers, respectively.

11. The refrigeration device according to claim 1, wherein the refrigerant flowing out from a low stage side evaporator of the low stage side refrigerant circuit is sucked into a low stage side compressor of the low stage side refrigerant circuit without performing heat exchange between the refrigerant and the high pressure side refrigerant of the low stage side refrigerant circuit, and an accumulator is disposed on a suction side of the low stage side compressor.

12. The refrigeration device according to claim 11,
wherein the low stage side refrigerant circuit has a low stage side compressor and a low stage side gas cooler, and
the cascade heat exchanger subcools the refrigerant flowing out from the low stage side gas cooler.

13. The refrigeration device according to claim 11,
which comprises a plurality of low stage side refrigerant circuits, and a plurality of cascade heat exchangers disposed in the respective low stage side refrigerant circuits, respectively,
wherein the high stage side refrigerant circuit has a plurality of high stage side gas coolers connected in parallel, a plurality of high stage side expansion valves connected to outlets of the respective high stage side gas coolers, respectively, and a plurality of high stage side evaporators connected to outlets of the respective high stage side expansion valves, respectively, to constitute the respective cascade heat exchangers, respectively.

14. The refrigeration device according to claim 1,
wherein the low stage side refrigerant circuit has a low stage side compressor and a low stage side gas cooler, and
the cascade heat exchanger subcools the refrigerant flowing out from the low stage side gas cooler.

15. The refrigeration device according to claim 14,
which comprises a plurality of low stage side refrigerant circuits, and a plurality of cascade heat exchangers disposed in the respective low stage side refrigerant circuits, respectively,
wherein the high stage side refrigerant circuit has a plurality of high stage side gas coolers connected in parallel, a plurality of high stage side expansion valves connected to outlets of the respective high stage side gas coolers, respectively, and a plurality of high stage side evaporators connected to outlets of the respective high stage side expansion valves, respectively, to constitute the respective cascade heat exchangers, respectively.

16. The refrigeration device according to claim 14,
which comprises a plurality of low stage side refrigerant circuits, and a plurality of cascade heat exchangers disposed in the respective low stage side refrigerant circuits, respectively,
wherein the high stage side refrigerant circuit has a high stage side gas cooler, a high stage side expansion valve connected to an outlet of the high stage side gas cooler, and a plurality of high stage side evaporators connected in parallel to an outlet of the high stage side expansion valve to constitute the respective cascade heat exchangers, respectively.

17. The refrigeration device according to claim 14,
which comprises a plurality of low stage side refrigerant circuits, and a plurality of cascade heat exchangers disposed in the respective low stage side refrigerant circuits, respectively,
wherein the high stage side refrigerant circuit has a high stage side gas cooler, a high stage side expansion valve connected to an outlet of the high stage side gas cooler, and a plurality of high stage side evaporators connected in series to an outlet of the high stage side expansion valve to constitute the respective cascade heat exchangers, respectively.

18. The refrigeration device according to claim 1,
which comprises a plurality of low stage side refrigerant circuits, and a plurality of cascade heat exchangers disposed in the respective low stage side refrigerant circuits, respectively,
wherein the high stage side refrigerant circuit has a plurality of high stage side gas coolers connected in parallel, a plurality of high stage side expansion valves connected to outlets of the respective high stage side gas coolers, respectively, and a plurality of high stage side evaporators connected to outlets of the respective high stage side expansion valves, respectively, to constitute the respective cascade heat exchangers, respectively.

19. The refrigeration device according to claim 1,
which comprises a plurality of low stage side refrigerant circuits, and a plurality of cascade heat exchangers disposed in the respective low stage side refrigerant circuits, respectively,
wherein the high stage side refrigerant circuit has a high stage side gas cooler, a high stage side expansion valve connected to an outlet of the high stage side gas cooler, and a plurality of high stage side evaporators connected in parallel to an outlet of the high stage side expansion valve to constitute the respective cascade heat exchangers, respectively.

20. The refrigeration device according to claim 1,
which comprises a plurality of low stage side refrigerant circuits, and a plurality of cascade heat exchangers disposed in the respective low stage side refrigerant circuits, respectively,
wherein the high stage side refrigerant circuit has a high stage side gas cooler, a high stage side expansion valve connected to an outlet of the high stage side gas cooler, and a plurality of high stage side evaporators connected in series to an outlet of the high stage side expansion valve to constitute the respective cascade heat exchangers, respectively.

* * * * *